US012768354B1

(12) United States Patent
Sabha

(10) Patent No.: US 12,768,354 B1
(45) Date of Patent: Oct. 20, 2026

(54) ELECTRIC COMPRESSOR

(71) Applicant: MAHLE INTERNATIONAL GMBH, Stuttgart (DE)

(72) Inventor: Nick George Sabha, Lewiston, NY (US)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 19/239,160

(22) Filed: Jun. 16, 2025

(51) Int. Cl.
*F04C 18/02* (2006.01)
*F04C 29/12* (2006.01)

(52) U.S. Cl.
CPC ..... *F04C 18/0215* (2013.01); *F04C 18/0261* (2013.01); *F04C 29/12* (2013.01); *F04C 2240/403* (2013.01)

(58) Field of Classification Search
CPC .. F04C 18/0215; F04C 18/0261; F04C 29/12; F04C 2240/403
USPC ..... 418/55.1, 55.2
See application file for complete search history.

(56) References Cited

U.S. PATENT DOCUMENTS

| | | | | |
|---|---|---|---|---|
| 4,477,238 | A | 10/1984 | Terauchi | |
| 4,886,427 | A | 12/1989 | Sakurai et al. | |
| 5,533,875 | A | 7/1996 | Crum et al. | |
| 7,074,023 | B2 * | 7/2006 | Matsunaga | F04C 29/12 418/55.1 |
| 7,140,852 | B2 | 11/2006 | Koide et al. | |
| 9,441,630 | B2 | 9/2016 | Kiem et al. | |
| 11,629,713 | B1 * | 4/2023 | Haseley | F04C 29/0057 418/55.6 |
| 12,049,893 | B2 | 7/2024 | Haseley | |
| 2004/0146419 | A1 * | 7/2004 | Kawaguchi | F04C 28/14 418/55.1 |
| 2011/0200475 | A1 | 8/2011 | Hirata et al. | |
| 2015/0207438 | A1 | 7/2015 | Takami et al. | |
| 2020/0032795 | A1 | 1/2020 | Kim et al. | |
| 2020/0032798 | A1 | 1/2020 | Her et al. | |
| 2020/0080557 | A1 * | 3/2020 | Park | F04C 18/0215 |
| 2022/0170461 | A1 | 6/2022 | Inaba et al. | |

FOREIGN PATENT DOCUMENTS

| | | | |
|---|---|---|---|
| JP | S601396 | A | 1/1985 |
| JP | H06299976 | A | 10/1994 |
| JP | H1047268 | A | 2/1998 |
| JP | 2778585 | B2 | 7/1998 |
| JP | 2785805 | B2 | 8/1998 |
| JP | 2785806 | B2 | 8/1998 |
| JP | 2870488 | B2 | 3/1999 |
| JP | 2006274807 | A | 10/2006 |
| JP | 4918338 | B2 | 4/2012 |

(Continued)

*Primary Examiner* — Charles G Freay
(74) *Attorney, Agent, or Firm* — Endurance Law Group PLC; James R. Yee

(57) ABSTRACT

A compression device for use in a compressor includes a fixed scroll and an orbiting scroll. The orbiting scroll and the fixed scroll form a compression chamber for receiving the refrigerant from the intake volume and compressing the refrigerant as the orbiting scroll is rotated about the fixed scroll. The fixed scroll has a slot within the first side of the fixed scroll. The slot defines a secondary refrigerant pathway configured to allow refrigerant to enter the compression chamber during a compression cycle.

16 Claims, 11 Drawing Sheets

(56) References Cited

FOREIGN PATENT DOCUMENTS

| | | | |
|---|---|---|---|
| JP | 5209437 | B2 | 6/2013 |
| JP | 5222444 | B2 | 6/2013 |
| KR | 20100103139 | A | 9/2010 |
| KR | 20130011656 | A | 1/2013 |
| KR | 20130011658 | A | 1/2013 |
| KR | 101278809 | B1 | 6/2013 |
| KR | 101284953 | B1 | 7/2013 |
| KR | 20130126837 | A | 11/2013 |
| KR | 101362790 | B1 | 2/2014 |
| KR | 101731653 | B1 | 5/2017 |
| WO | 2013165157 | A1 | 11/2013 |
| WO | 2020090701 | A1 | 5/2020 |

* cited by examiner

ELECTRIC COMPRESSOR

FIELD OF THE INVENTION

The invention relates generally to electric compressor, and more particularly to an electric compressor that compresses a refrigerant using a scroll compression device.

BACKGROUND OF THE INVENTION

Compressors have long been used in cooling systems. In particular, scroll-type compressors, in which an orbiting scroll is rotated in a circular motion relative to a fixed scroll to compress a refrigerant, have been used in systems designed to provide cooling in specific areas. For example, such scroll-type compressors have long been used in the HVAC systems of motor vehicles, such as automobiles, to provide air-conditioning. Such compressors may also be used, in reverse, in applications requiring a heat pump. Generally, these compressors are driven using rotary motion derived from the automobile's engine.

With the advent of battery-powered or electric vehicles and/or hybrid vehicles, in which the vehicle may be solely powered by a battery at times, such compressors must be driven or powered by the battery rather than an engine. Such compressors may be referred to as electric compressors.

In addition to cooling a passenger compart of the motor vehicle, electric compressors may be used to provide heating or cooling to other areas or components of the motor vehicle. For instance, it may be desired to heat or cool the electronic systems and the battery or battery compartment, when the battery is being charged, especially during fast charging modes, as such generate heat which may damage or degrade, the battery and/or other system. It may also be used to cool the battery during times when the battery is not being charged or used, as heat may damage or degrade the battery. Since the electric compressor may be run at various times, even when the motor vehicle is not in operation, such use, obviously, requires electrical energy from the battery, thus reducing the operating time of the battery.

Scroll compressors include fixed and orbiting scrolls with fixed and orbiting scroll laps which form an expanding scroll pocket or compress chamber during a compression cycle. In some prior art compressors, the geometry of the fixed and orbiting scroll laps choking the flow of refrigerant into the compression chamber, for example, when the compression chamber is at its maximum size. This may reduce the performance, increase a pressure imbalance across the compressor, and generate unwanted levels of noise.

It is thus desirable, to provide an electric compressor having high efficiency, low-noise and maximum operating life. The present invention is aimed at one or more of the problems or advantages identified above.

BRIEF SUMMARY OF THE INVENTION

In a first aspect of the present invention, a scroll-type electric compressor configured to compress a refrigerant provided. The compressor includes a housing, a refrigerant inlet port, a refrigerant outlet port, an inverter module, a drive shaft, and a compression device. The housing defines an intake volume and a discharge volume. The refrigerant inlet port is coupled to the housing and is configured to introduce the refrigerant to the intake volume. The refrigerant outlet port is coupled to the housing and is configured to allow compressed refrigerant to exit the scroll-type electric compressor from the discharge volume. The inverter module is mounted inside the housing and is adapted to convert direct current electrical power to alternating current electrical power. The motor is mounted inside the housing. The drive shaft is coupled to the motor.

The compression device is coupled to the drive shaft and is configured to receive the refrigerant from the intake volume. The compression device includes a fixed scroll and an orbiting scroll. The fixed scroll has first and second sides of the fixed scroll and is located within, and fixed relative to, the housing. The orbiting scroll has first and second sides of the orbiting scroll. The fixed scroll includes a fixed scroll base defining a fixed scroll base floor and being located at the first side of the fixed scroll and a fixed scroll lap extending from the fixed scroll base floor towards the second side of the fixed scroll. The orbiting scroll includes an orbiting scroll base located at the first side of the orbiting scroll and an orbiting scroll lap extending from the fixed scroll base towards the second side of the orbiting scroll.

The orbiting scroll is coupled to the drive shaft. The orbiting scroll and the fixed scroll form a compression chamber for receiving the refrigerant from the intake volume and compressing the refrigerant during a compression cycle as the drive shaft is rotated. The fixed scroll has a slot within the first side of the fixed scroll. The slot defines an alternative pathway configured to allow refrigerant to enter the compression chamber during a compression cycle.

In a second aspect of the present invention, a compression device for use in a scroll-type electric compressor is provided. The compression device includes a fixed scroll and an orbiting scroll. The fixed scroll includes a fixed scroll base defining a fixed scroll base floor and located at the first side of the fixed scroll and a fixed scroll lap extending from the fixed scroll base floor towards the second side of the fixed scroll. The orbiting scroll includes an orbiting scroll base located at the first side of the orbiting scroll and an orbiting scroll lap extending from the fixed scroll base towards the second side of the orbiting scroll. The orbiting scroll and the fixed scroll form a compression chamber for receiving the refrigerant from the intake volume and compressing the refrigerant as the orbiting scroll is rotated about the fixed scroll. The fixed scroll has a slot within the first side of the fixed scroll. The slot defining a secondary refrigerant pathway configured to allow refrigerant to enter the compression chamber during a compression cycle.

In a third aspect of the present invention, a scroll-type electric compressor configured to compress a refrigerant is provided. The scroll-type compressor includes a housing, a refrigerant inlet port, a refrigerant outlet port, an inverter, a motor, a drive shaft, and a compression device. The housing defines an intake volume and a discharge volume. The refrigerant inlet port is coupled to the housing and is configured to introduce the refrigerant to the intake volume. The refrigerant outlet port is coupled to the housing and is configured to allow compressed refrigerant to exit the scroll-type electric compressor from the discharge volume. The inverter module is mounted inside the housing and is adapted to convert direct current electrical power to alternating current electrical power. The motor is mounted inside the housing. The drive shaft is coupled to the motor.

The compression device is coupled to the drive shaft and is configured to receive the refrigerant from the intake volume. The compression device includes a fixed scroll and an orbiting scroll. The fixed scroll has first and second sides of the fixed scroll and is located within, and fixed relative to, the housing. The orbiting scroll has first and second sides of the orbiting scroll. The fixed scroll base defines a fixed scroll base floor and is located at the first side of the fixed scroll.

The fixed scroll lap extends from the fixed scroll base floor towards the second side of the fixed scroll. The orbiting scroll includes an orbiting scroll base located at the first side of the orbiting scroll. The orbiting scroll lap extends from the fixed scroll base towards the second side of the orbiting scroll. The orbiting scroll is coupled to the drive shaft. The orbiting scroll and the fixed scroll form a compression chamber for receiving the refrigerant from the intake volume and compressing the refrigerant during a compression cycle as the drive shaft is rotated. The fixed scroll has a slot within the first side of the fixed scroll. The slot defines a secondary refrigerant pathway configured to allow refrigerant to enter the compression chamber during the compression cycle. The secondary refrigerant pathway is closed at initiation of the compression cycle and the secondary refrigerant pathway is fully open at a predetermined point within the compression cycle, The predetermined point is approximately halfway within the compression cycle. The fixed scroll includes a fixed scroll wall, the slot being adjacent the fixed scroll wall.

BRIEF DESCRIPTION OF THE SEVERAL VIEWS OF THE DRAWINGS

These and other features and advantages of the present invention will become more readily appreciated when considered in connection with the following detailed description and appended drawings.

DETAILED DESCRIPTION OF THE INVENTION

Figure 1A:
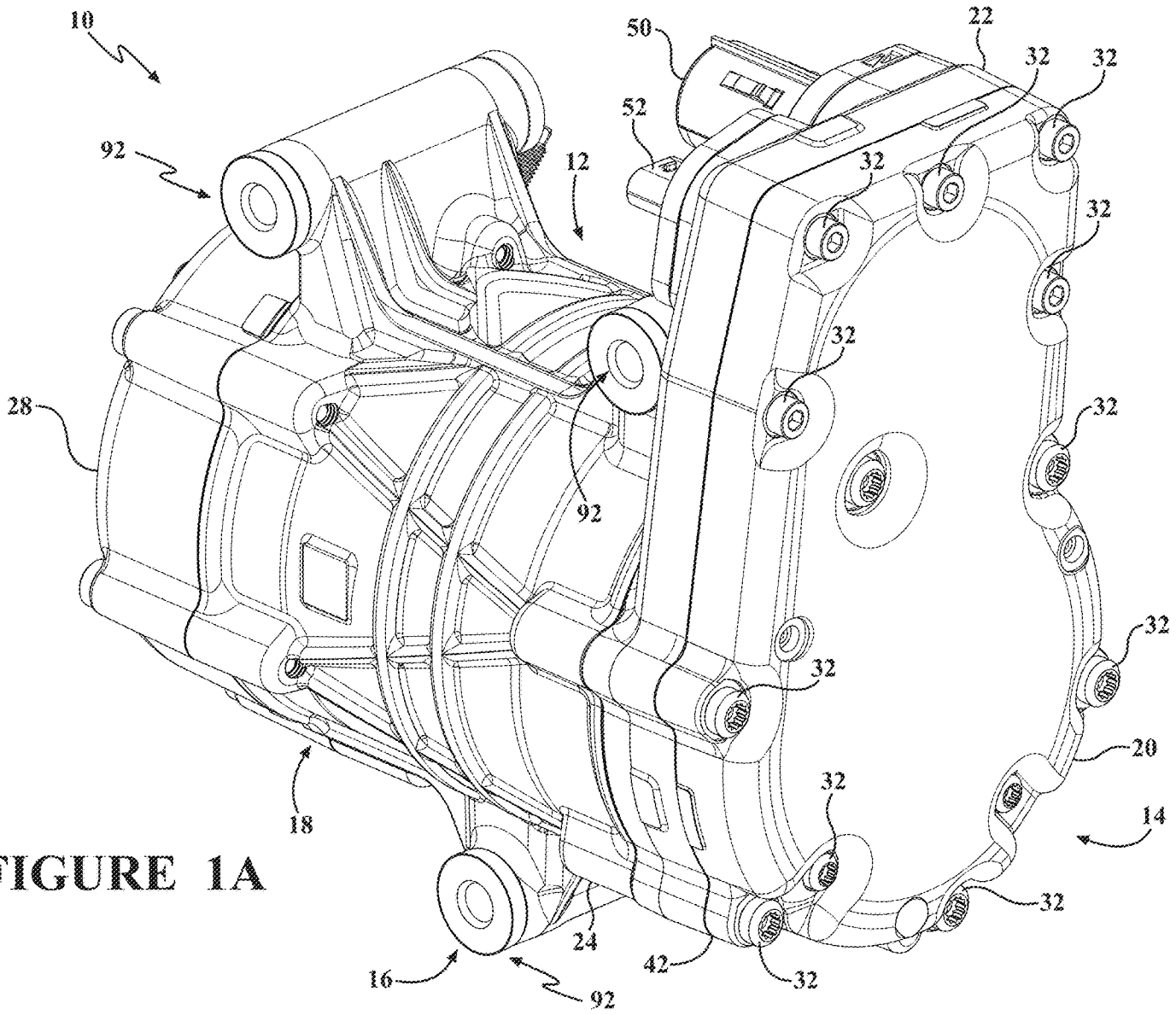
FIG. 1A is a first perspective view of an electric scroll-type compressor, according to an embodiment of the present invention.
Figure 1B:
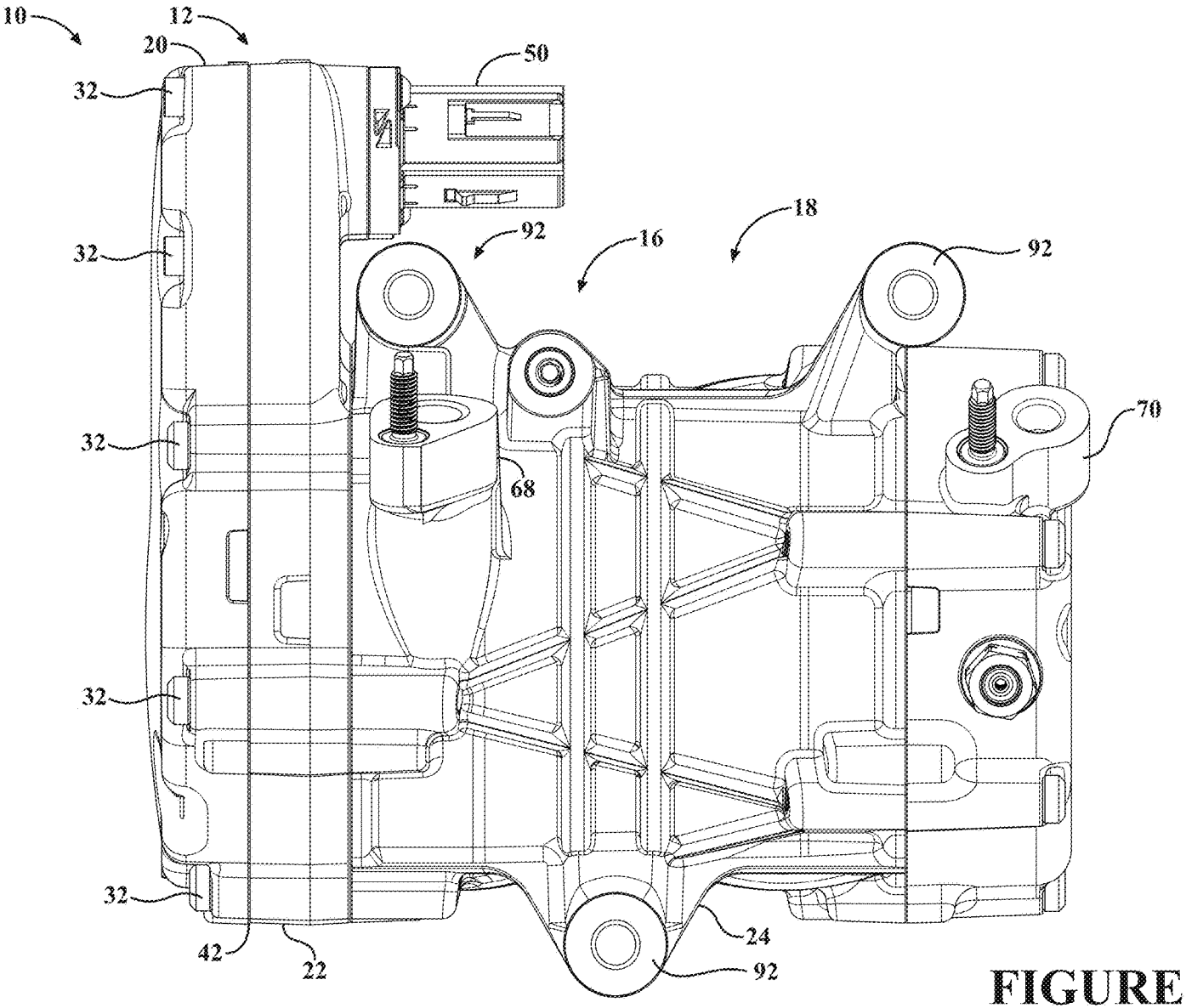
FIG. 1B is a second perspective view of an electric scroll-type compressor, according to an embodiment of the present invention.
Figure 1C:
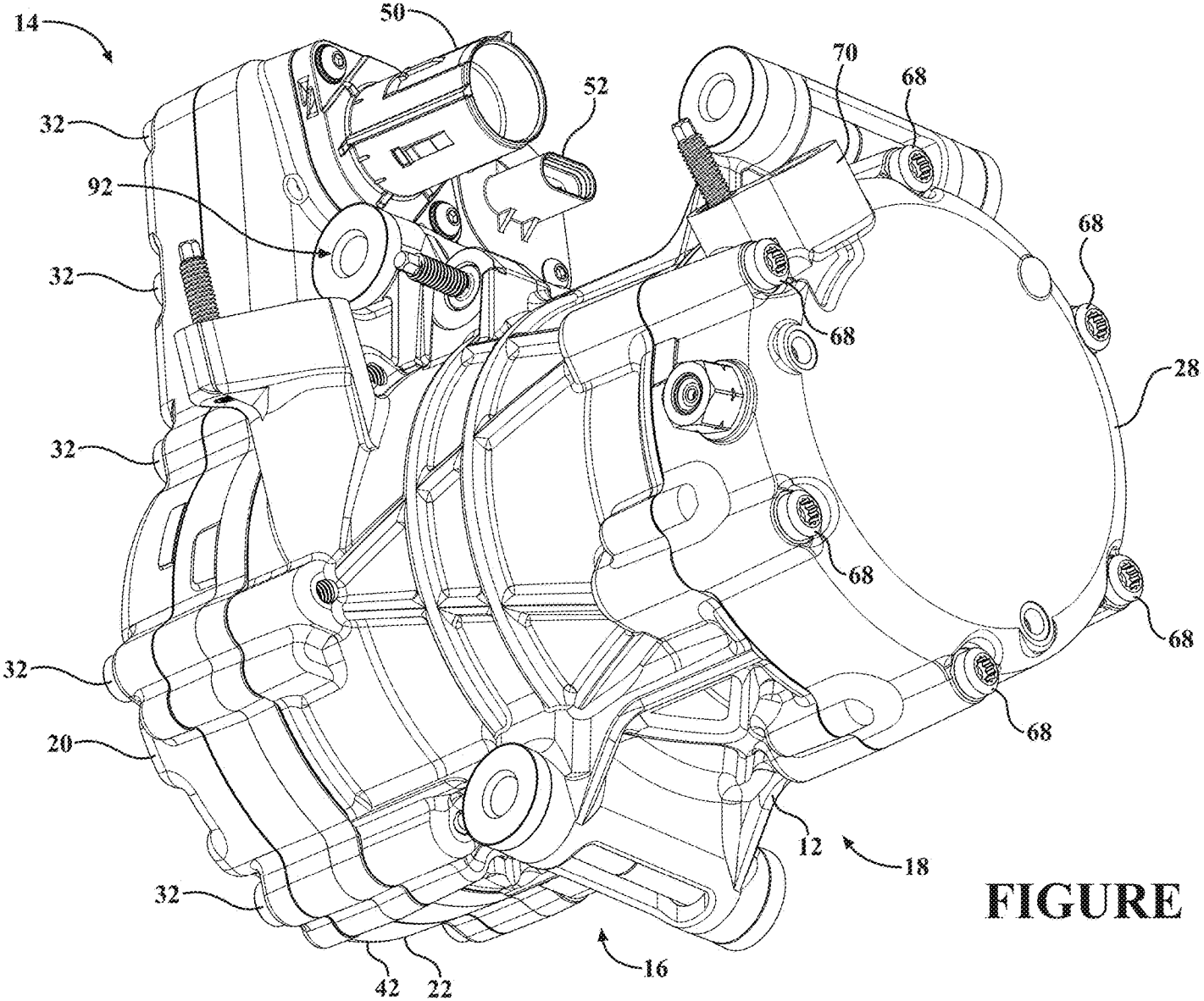
FIG. 1C is a third perspective view of an electric scroll-type compressor, according to an embodiment of the present invention.

Referring to FIGS. 1A-1C, 2, 4A-4B, 5A-5F, and 6A-6F, wherein like numerals indicate like or corresponding parts throughout the several views, an electric compressor 10 having housing 12 is provided. The electric compressor 10 is particularly suitable in a motor vehicle, such as an automotive vehicle (not shown). The electric compressor 10 may be used as a cooling device or as a heating pump to heat and/or cool different aspects of the vehicle. For instance, the electric compressor 10 may be used as part of the heating, ventilation and air conditioning (HVAC) system in electric vehicles (not shown) to cool or heat a passenger compartment. In addition, the electric compressor 10 may be used to heat or cool the passenger compartment, on-board electronics and/or a battery used for powering the vehicle while the vehicle is not being operated, for instance, during a charging cycle. The electric compressor 10 may further be used while the vehicle is not being operated and while the battery is not being charged to maintain, or minimize the degradation, of the life of the battery.

In the illustrated embodiment, the electric compressor 10 is a scroll-type compressor that acts to compress a refrigerant rapidly and efficiently for use in different systems of a motor vehicle, for example, an electric or a hybrid vehicle. The electric compressor 10 includes an inverter section 14, a motor section 16, and a compression device (or compression assembly) 18 contained within the housing 12. The outer housing 12 includes an inverter back cover 20, an inverter housing 22 and a center housing 24 (which may be integral), a front cover 28 (which may be referred to as the discharge head). The center housing 24 houses the motor section 16 and the compression device 18.

In one embodiment, the inverter back cover 20, the inverter housing 22, the center housing 24, and the front cover 28 are composed from machined aluminum. The inverter 10 may be mounted, for example, within the body of a motor vehicle, via a plurality of mount points (not shown). In one aspect of the electric compressor 10, the electric compressor 10 may have or define a secondary refrigerant pathway 100 (FIGS. 4A-4B, 5C-5F, and 6A-6F) to allow refrigerant to enter the compression device 18 during a compression cycle (see below).

General Arrangement, and Operation, of the Electric Compressor 10

With reference to FIGS. 1A-1C and 2, in the illustrated embodiment, the inverter back cover 20 and the inverter housing 22 form an inverter cavity 30. The inverter back cover 20 is mounted to the inverter housing 22 or to the inverter housing 22 and the center housing are connected by a plurality of bolts 32. An inverter gasket 42, positioned between the inverter back cover 20 and the inverter housing 22 keeps moisture, dust, and other contaminants from the inverter cavity 30.

An inverter module 44 is mounted within the inverter cavity 30 formed by the inverter back cover 20 and the inverter housing 22. The inverter module 44 may include an inverter circuit (not shown) mounted on a printed circuit board (not shown), which is mounted to the inverter housing 22. The inverter circuit converts direct current (DC) electrical power received from outside of the electric compressor 10 into three-phase alternating current (AC) power to supply/power a motor 54 (see below). The inverter circuit may also control the rotational speed of the electric compressor 10. High voltage DC current is supplied to the inverter circuit via a high voltage connector 50. Low voltage DC current to drive the inverter circuit, as well as control signals to control operation of the inverter circuit, and the motor section 16, may be supplied via a low voltage connecter 52.

The center housing 24 forms a motor cavity 56. The motor section 16 includes a motor 54 located within the motor cavity 56. With specific reference to FIG. 12, in the illustrated embodiment, the motor 54 is a three-phase AC motor having a stator 58. The stator 58 has a generally hollow cylindrical shape with six individual coils (two for each phase). The stator 58 is contained within, and mounted to, the motor housing 22 and remains stationery relative to the motor housing 22.

The motor 54 includes a rotor 60 located within, and centered relative to, the stator 58. The rotor 60 has a generally hollow cylindrical shape and is located within the stator 58.

A drive shaft 90 is coupled to the rotor 60 and rotates therewith. In the illustrated embodiment, the draft shaft 90 is press-fit within a center aperture 60A of the rotor 60. The drive shaft 90 has a first end 90A and a second end 90B. In the illustrated embodiment, the inverter housing 22 includes a first drive shaft supporting member 22A located on the motor side of the inverter housing 22. A first ball bearing 62 located within an aperture formed by the first drive shaft supporting member 22A supports and allows the first end of the drive shaft 90A to rotate. The center housing 24 includes a second drive shaft supporting member 24A. A second ball bearing 64 located within an aperture formed by the second drive shaft supporting member 24A allows the second end 90B of the drive shaft 90 to rotate. In the illustrated embodiment, the first and second ball bearing 62, 64 are press-fit with the apertures formed by the first drive shaft supporting member 22B of the inverter housing 22 and the second drive shaft supporting member 24A of the center housing 24, respectively.

As stated above, the electric compressor 10 is a scroll-type compressor. The compression device 18 includes the fixed scroll 26 and an orbiting scroll 66. The orbiting scroll 66 is fixed to the second end of the rotor 60B. The rotor 60 with the drive shaft 90 rotates to drive the orbiting scroll 66 motion under control of the inverter module 44.

The drive shaft 90 has a central axis 90C around which the rotor 60 and the drive shaft 90 are rotated. The orbiting scroll 66 moves about the central axis 90C in an eccentric orbit, i.e., in a circular motion while the orientation of the orbiting scroll 66 remains constant with respect to the fixed scroll 26. The center of the orbiting scroll 66 is located along an offset axis (not shown) of the drive shaft 90. In the illustrated embodiment, the front cover 28 and the fixed scroll 26 are mounted to the motor housing 24 by a plurality of bolts 68 inserted through respective apertures therein and threaded into apertures in the motor housing 24.

Generally, intermixed refrigerant and oil (at low pressure) enters the electric compressor 10 via a refrigerant inlet port 68 and exits the electric compressor 10 (at high pressure) via refrigerant outlet port 70 after being compressed by the compression device 18. Refrigerant follows a refrigerant path through the electric compressor 10. Refrigerant enters the refrigerant inlet port 68 and enters an intake volume 74 formed between the motor side of the inverter housing 22 and the center housing 24 adjacent the refrigerant inlet port 68. Refrigerant is then drawn through the motor section 16 and enters a compression intake volume formed between an internal wall of the fixed scroll 26 and the orbiting scroll 66.

The fixed scroll 26 is mounted within the center housing 24. Refrigerant enters the compression device 12 from the compression intake volume. The fixed scroll 26 and the orbiting scroll 66 form compression chambers 80 in which low or unpressurized (saturation pressure) refrigerant enters the compression device 12. As the orbiting scroll 66 moves to enable the compression chambers 80 to be closed off and the volume of the compression chambers is reduced to pressurize the refrigerant. At any one time during the cycle, one or more compression chambers 80 are at different stages in the compression cycle. During a cycle of the compressor 10, the refrigerant is transported towards the center of the compression chambers 80.

Returning to FIG. 1, the front cover 28 forms a discharge volume 82. The discharge volume 82 is in communication with the refrigerant output port. Pressurized refrigerant leaves the compression device 18 through one or more orifices (not shown). The release of pressurized refrigerant is controlled by a reed mechanism 86 which may be a single reed or a multi-reed mechanism.

Secondary Refrigerant Pathway

Returning to FIG. 1, the front cover 28 forms a discharge volume 82. The discharge volume 82 is in communication with the refrigerant output port 70. Pressurized refrigerant leaves the compression device 18 through one or more orifices (not shown). The release of pressurized refrigerant is controlled by the reed mechanism 86.

Figure 2:
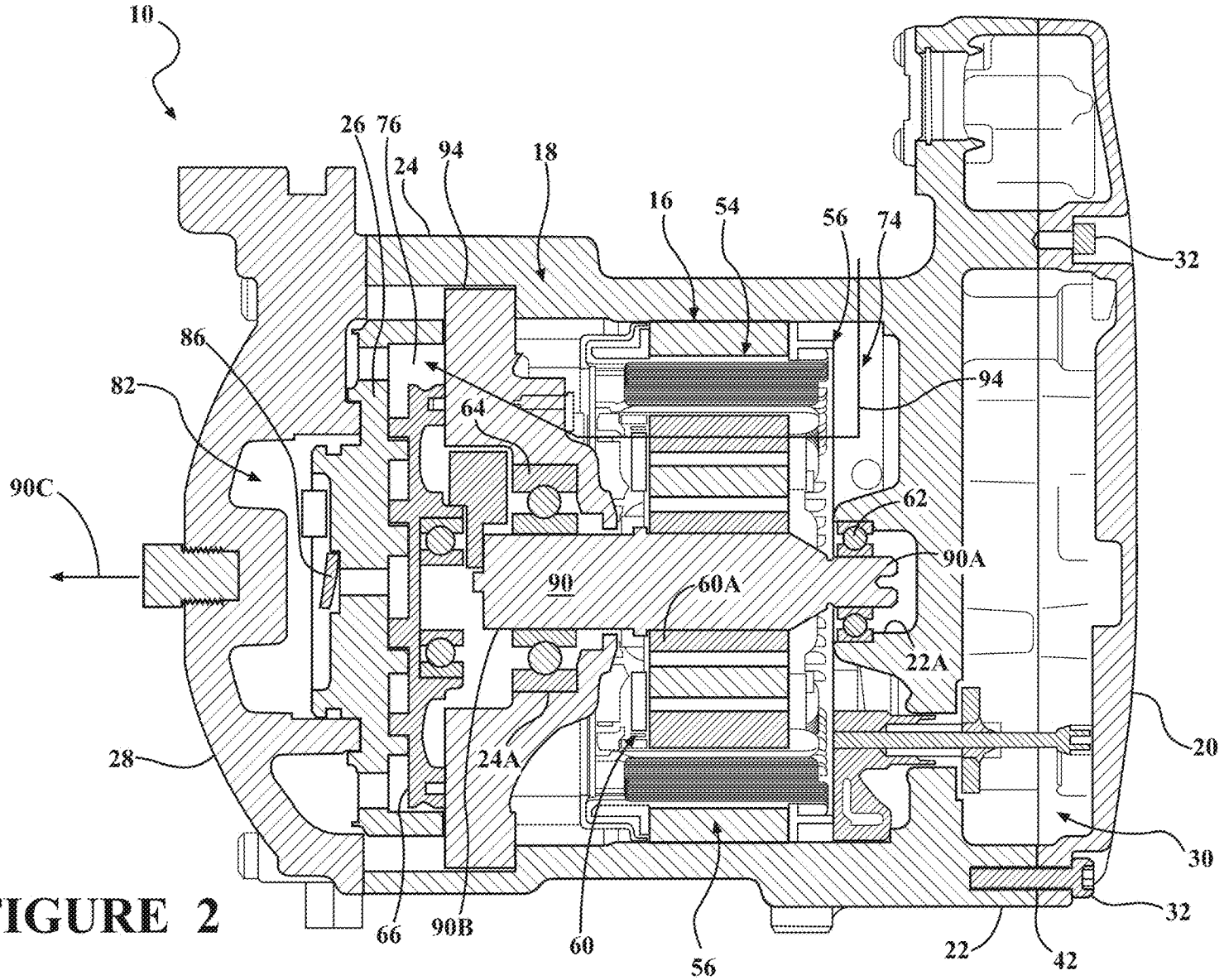
FIG. 2 is a cross-sectional view of the electric compressor of FIGS. 1A-1C.

With specific reference to FIG. 2, the compressor 10 defines a primary refrigerant path 94. As shown, refrigerant enters the refrigerant inlet port 68 and enters the intake volume 74 formed between the motor side of the inverter housing 22 and motor housing 24 adjacent the refrigerant inlet port 68. Refrigerant is then drawn through the motor section 16 and enters a compression intake volume 76 formed between an internal wall of the fixed scroll 26 and the orbiting scroll 66.

Figure 3A:
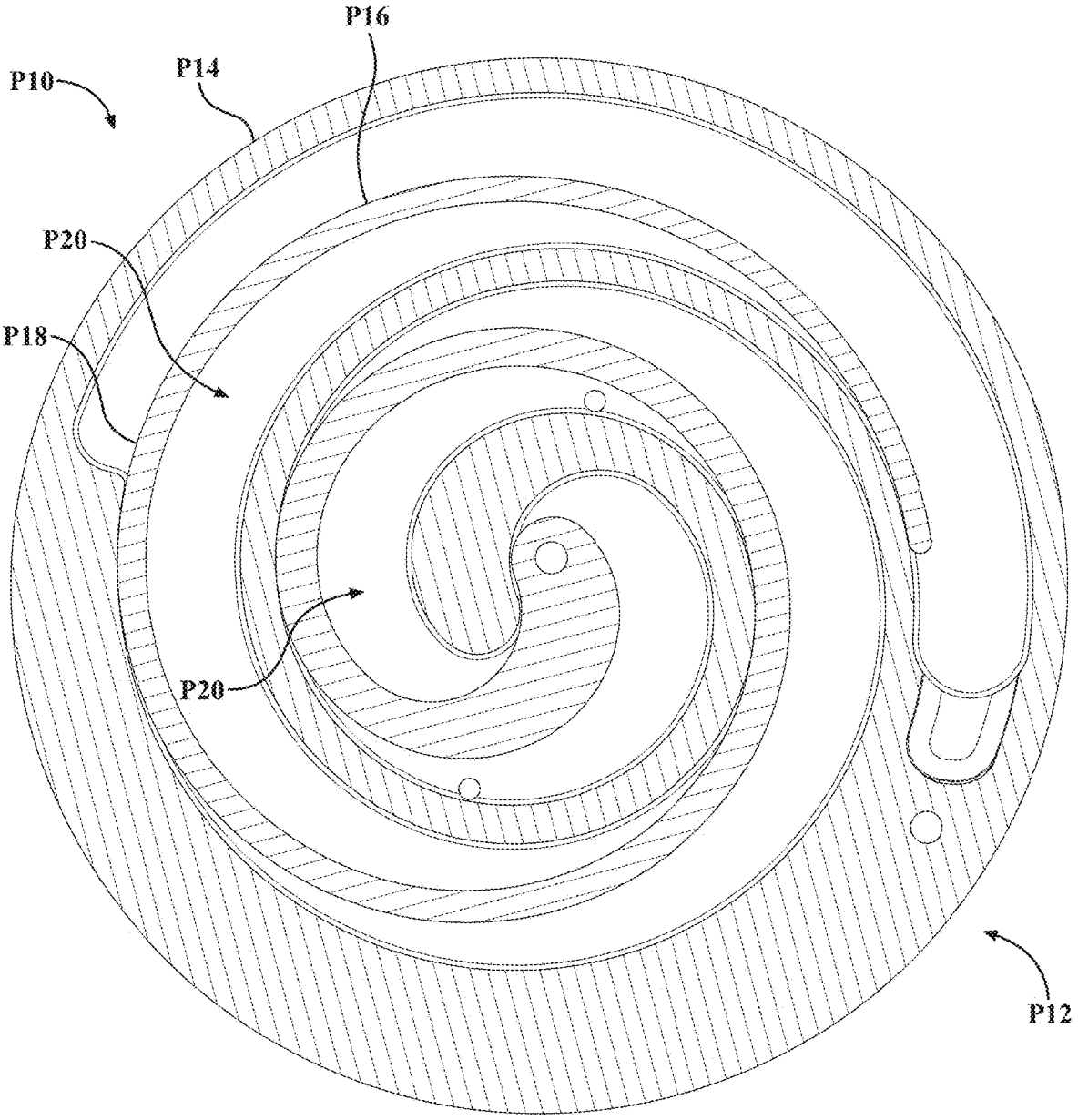
FIGURE 3A PRIOR ART
FIGS. 3A-3B are graphic depictions of a portion of a prior art electric compressor.
Figure 3B:
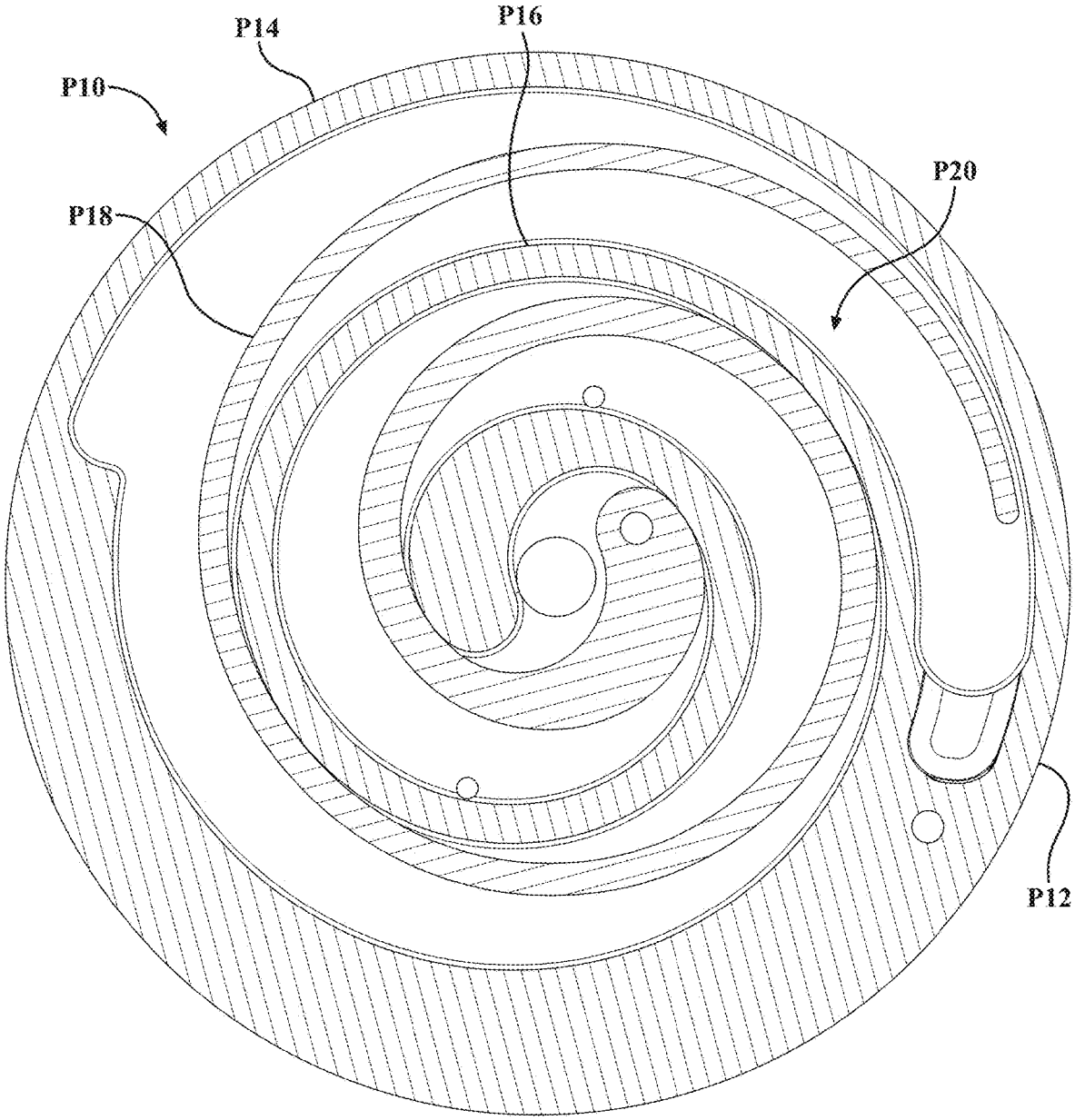
FIGURE 3B PRIOR ART

With reference to FIGS. 3A-3B, a portion of a compression device P10 of a prior art scroll-type compression is shown. The compression device P10 includes a fixed scroll P12 and an orbiting scroll. The fixed scroll P12 includes a fixed scroll outer wall P14 and a fixed scroll lap P16 and the orbiting scroll includes an orbiting scroll lap P18. During a compression cycle, the orbiting scroll is rotated relative the fixed scroll P12 and one or more compression chambers P20 may be created between the fixed and orbiting scroll laps P16 and P18. A compression chamber P20 is created at the initiation of a compression cycle. Initially, in a first portion of the compression cycle, the volume of compression chamber P20 enlarges until the volume reaches a maximum volume. During the first portion of the compression cycle, refrigerant enters the compression chamber P20. In the remainder of the compression cycle, the volume of the compression cycle P20 is reduced and the refrigerant within the compression chamber P20 is compressed.

FIG. 3A illustrates the prior art compression device P10 at initiation of compression cycle. FIG. 3B illustrates the prior art compression device P10 at a point in the compression cycle at which the compression chamber P20 is at a maximum volume. As shown, the tail end of the orbiting scroll lap P18 is close or adjacent to the fixed scroll outer wall P14. The proximity of the orbiting scroll lap P18 to the fixed scroll outer wall P14 may choke the flow of refrigerant into the compression chamber P20 resulting in reduced performance and increasing the pressure imbalance across the compression device P10.

With specific reference to FIGS. 4A-4B, 5A-5F, and 6A-6F, several views of a compression device 18 including a secondary refrigerant pathway 100 to enter the compression chamber 80 during a compression cycle.

As discussed above, the compression device 18 is coupled to the drive shaft 90 and is configured to receive the refrigerant from the intake volume 74. As shown, the compression device 18 includes a fixed scroll 26 and an orbiting scroll 66.

With reference to FIGS. 4A, 4B, 5A, and 5B, the orbiting scroll 66 has first and second sides 66A, 66B. The orbiting scroll 66 includes an orbiting scroll base 66C located at the first side 66A of the orbiting scroll 66. The orbiting scroll base 66C defines an orbiting scroll floor 66D located at the first side 66A of the orbiting scroll 66A. Further, the orbiting scroll 66 includes an orbiting scroll lap 66E extending from the first side 66A of the orbiting scroll 66 and the orbiting scroll base floor 66D towards the second side 66B of the orbiting scroll 66.

Figure 5A:
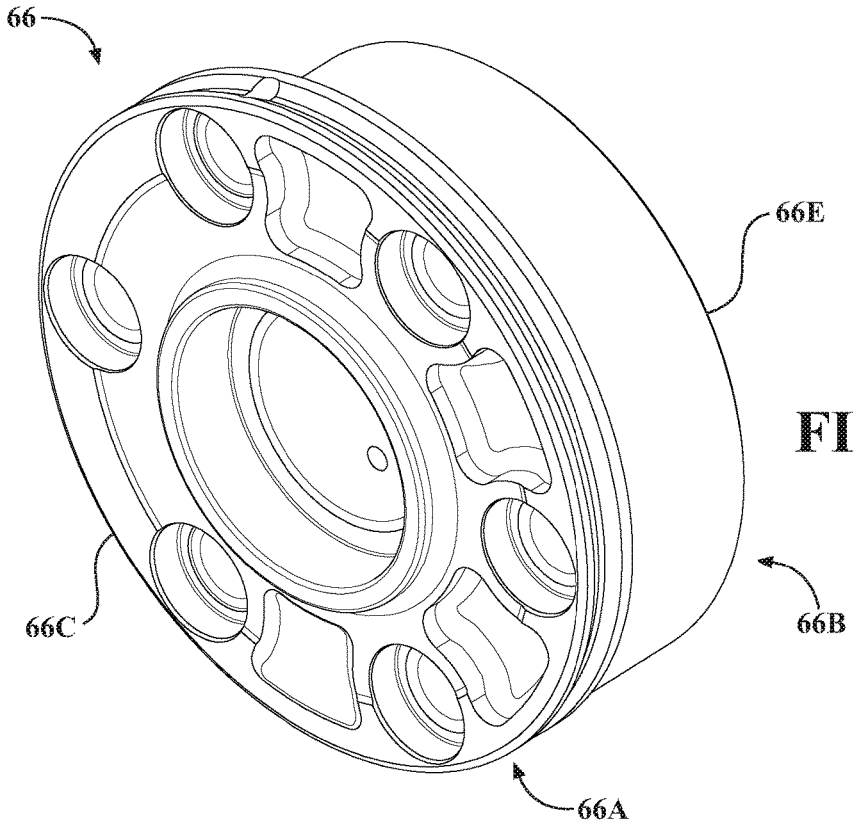
FIG. 5A is a first perspective view of an orbiting scroll of the electric-scroll compressor of FIG. 1, according to an embodiment of the present invention.
Figure 5B:
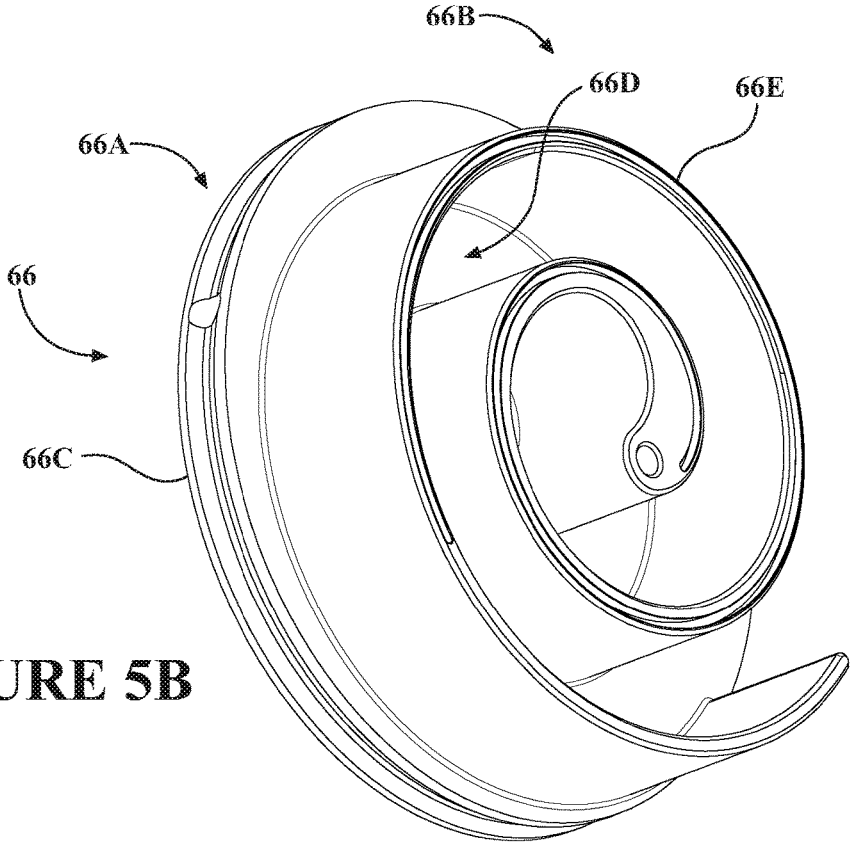
FIG. 5B is a second perspective view of the orbiting scroll of FIG. 5A.
Figure 5C:
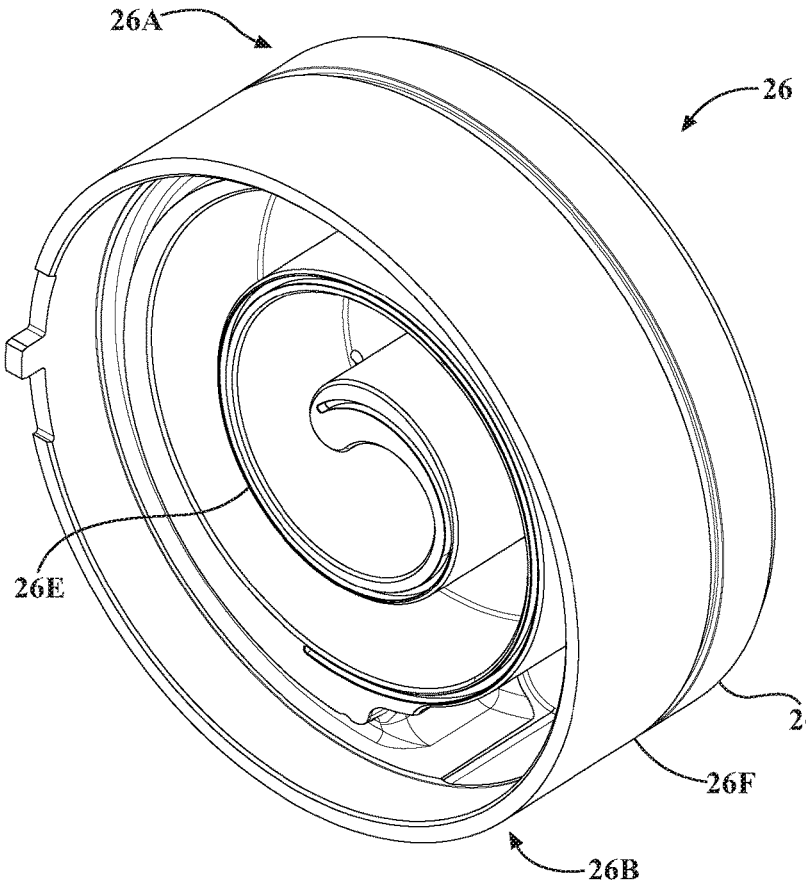
FIG. 5C is a first perspective view of a fixed scroll of the electric-scroll compressor of FIG. 1, according to an embodiment of the present invention.
Figure 5D:
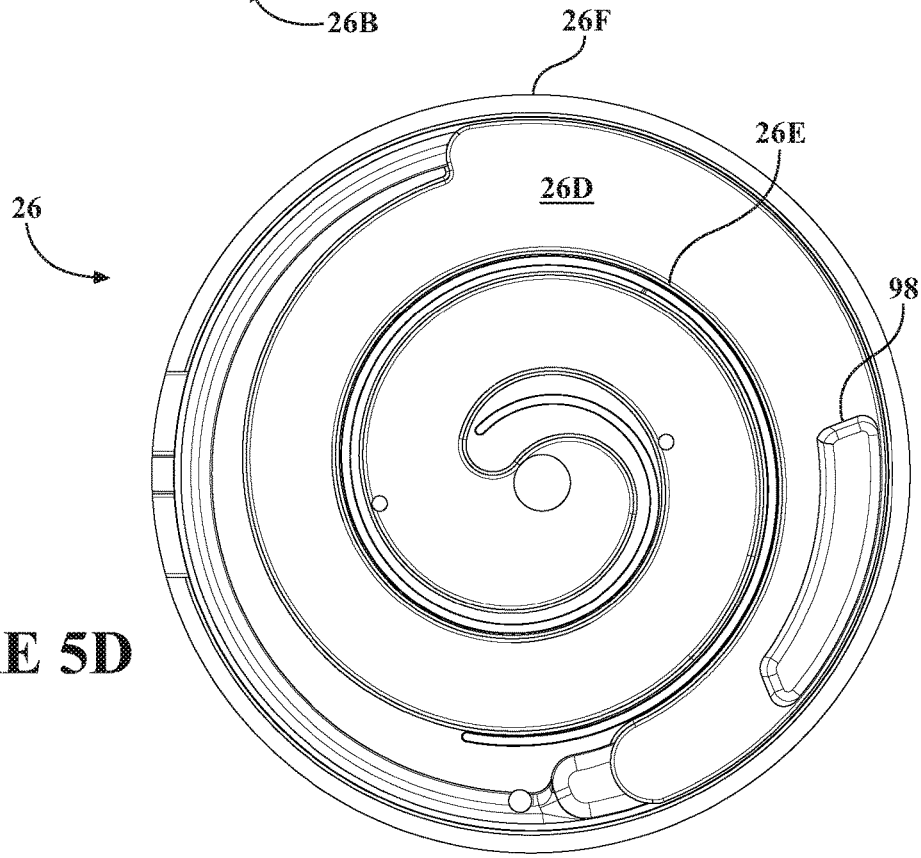
FIG. 5D is a front view of the fixed scroll of FIG. 5C.
Figure 5E:
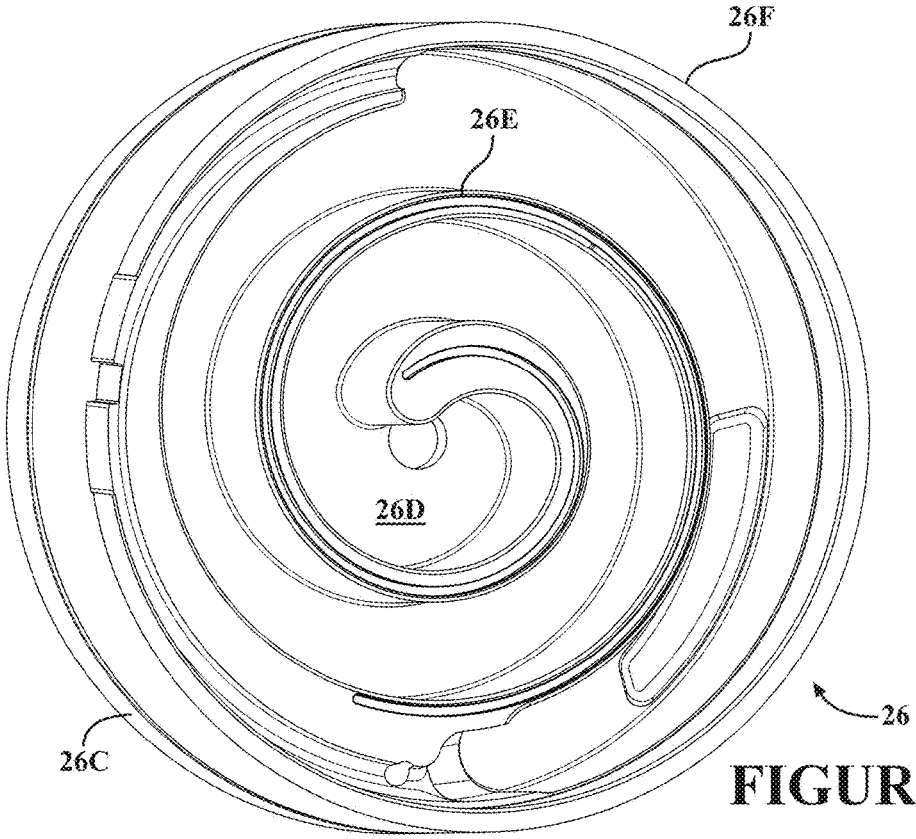
FIG. 5E is a second perspective view of the fixed scroll of FIG. 5C.
Figure 5F:
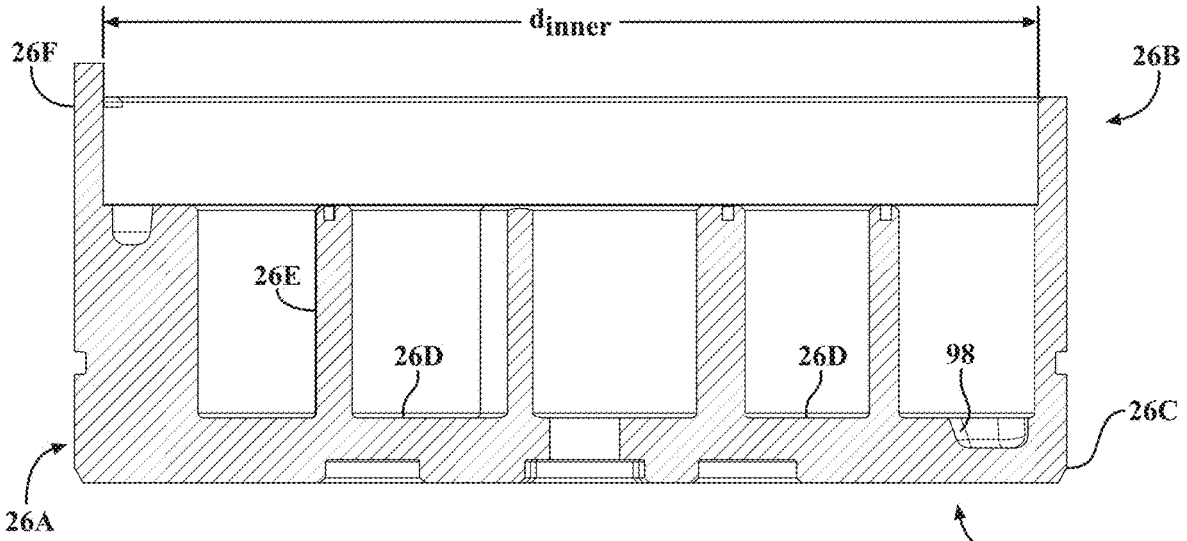
FIG. 5F is a cross-section view of the fixed scroll of FIG. 5C.

The fixed scroll 26 is located within, and fixed to, the housing 12. As shown in FIGS. 5C-5E, the fixed scroll 26 has first and second sides 26A, 26B. The fixed scroll 26 includes a fixed scroll base 26C located at the first side 26A of the fixed scroll 26. The fixed scroll base 26C defines a fixed scroll floor 26D located at the first side 26A of the fixed scroll 26A. Further, the fixed scroll 26 includes a fixed scroll lap 26E extending from the first side 26A of the fixed scroll 26 and the fixed scroll base floor 26D towards the second side 26B of the fixed scroll 26. The fixed scroll 26 further includes a fixed scroll outer wall 26F extending from the outer perimeter of the first side 26A of the fixed scroll 26 towards the second side 26B of the fixed scroll 26.

As discussed above, the orbiting scroll 66 is coupled to the drive shaft 90. As discussed above, the orbiting scroll 66 and the fixed scroll 26 form one or more compression chambers 80 during a compression cycle. The compression chambers 80 receive refrigerant from the intake volume 74 and compress the refrigerant during a compression cycle as the drive shaft 90 is rotated. In the illustrated embodiment, refrigerant is received or delivered into the compression chambers 80 during at least a portion of the compression cycle along the primary refrigerant pathway 94 and the secondary pathway 96.

In the illustrated embodiment, the secondary pathway 96 is at least partially defined by a slot 98 within the first side 26A of the fixed scroll 26. As shown, the slot 98 is open to the interior of the fixed scroll 26, i.e., has an open side through the fixed scroll base floor 26D. As discussed above, the secondary refrigerant pathway 96 is to allow refrigerant to enter the compression chamber 80 during a suction cycle.

Figure 4A:
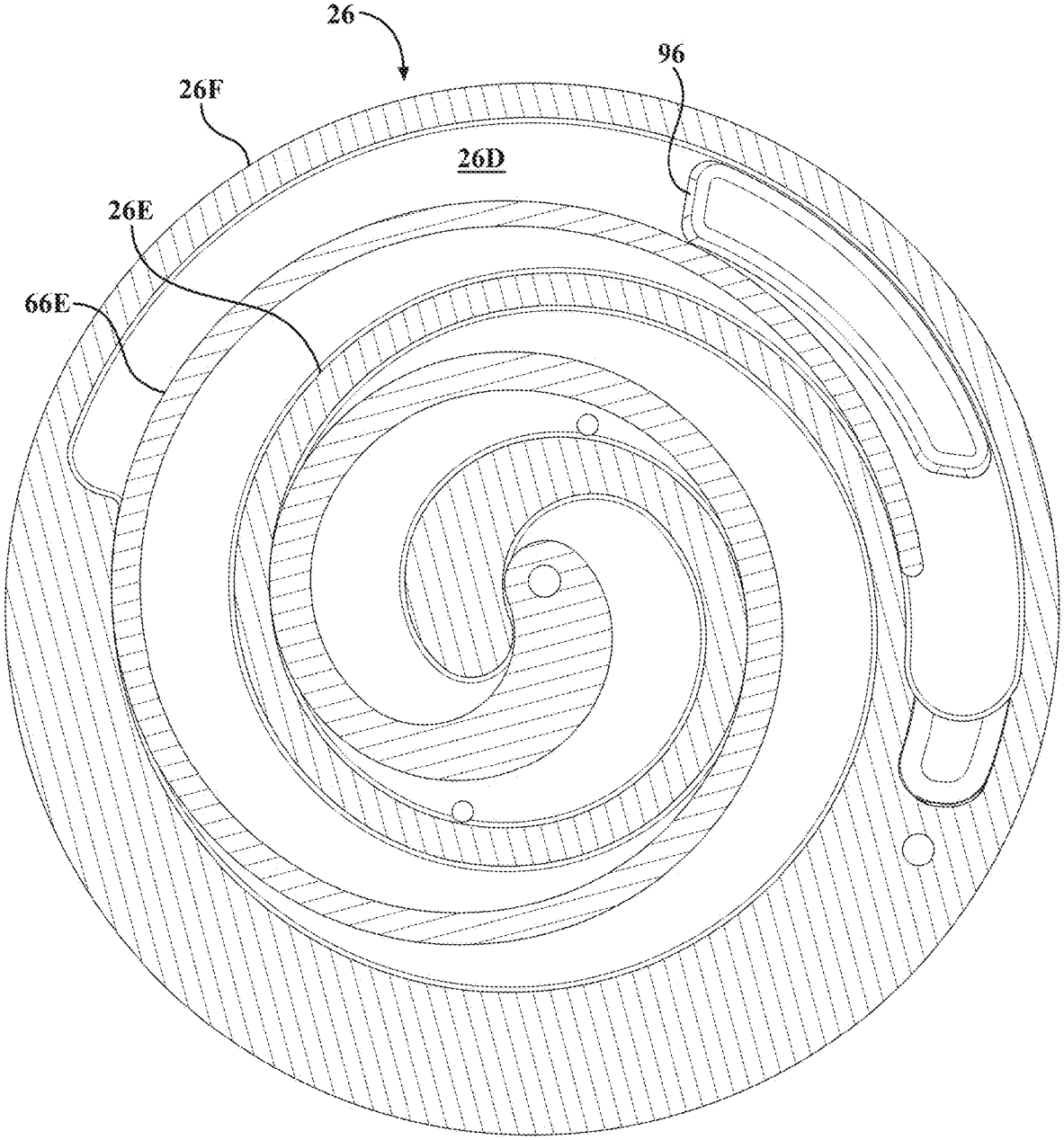
FIG. 4A is a first graphic depiction of a portion of an electric scroll-type compressor, according to an embodiment of the present invention.
Figure 4B:
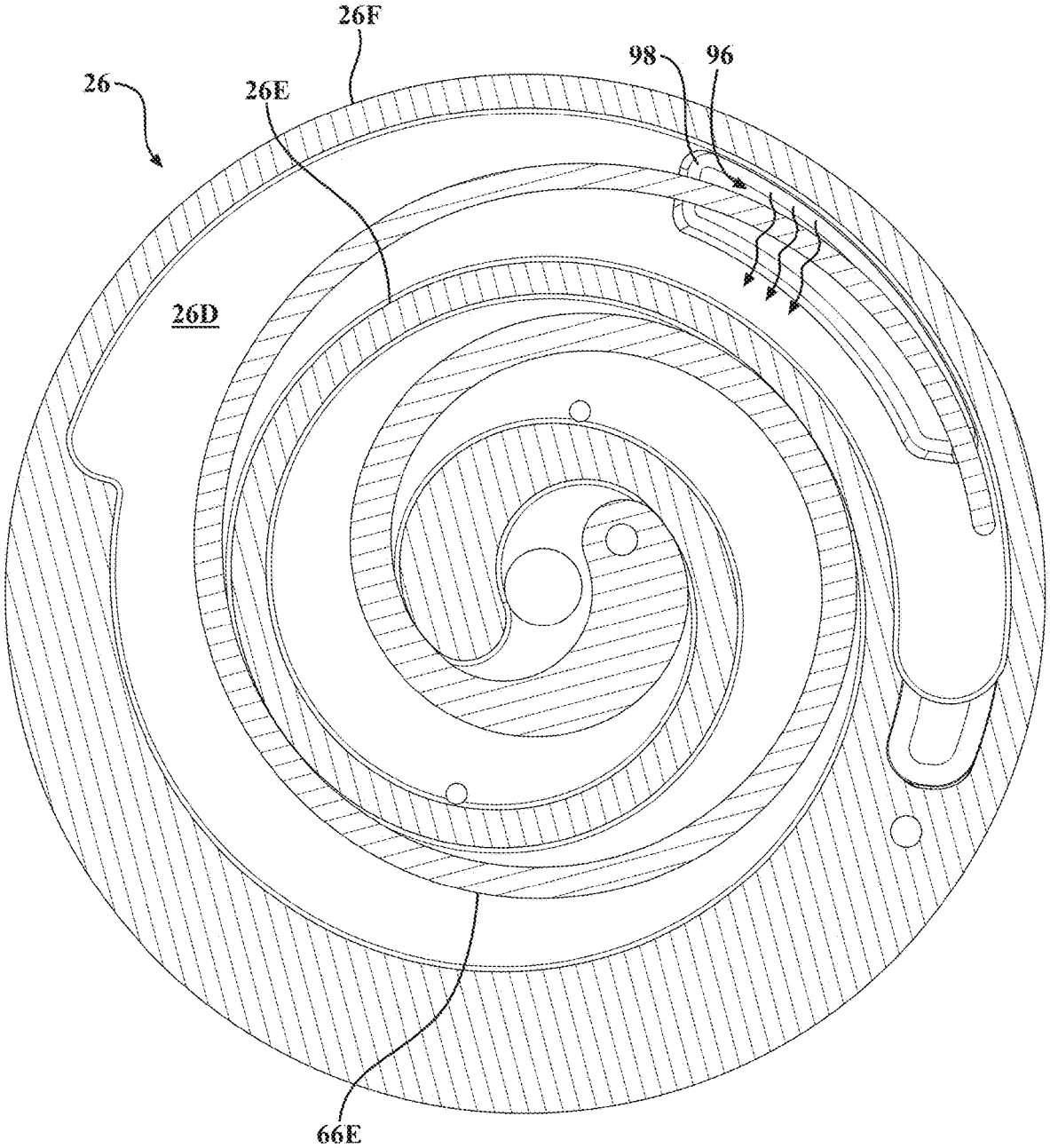
FIG. 4B is a second graphic depiction of a portion of the electric scroll-type compressor of FIG. 4A.

FIGS. 4A-4B and FIGS. 5A-5F illustrate a compression device 18 according to a first embodiment of the present invention. As shown in FIG. 4A, the compression device 18 is at the beginning or initiation of a compression cycle. The tail end of the orbiting scroll lap 66E is adjacent or in contact with the fixed scroll lap 26E. As shown, with the tail end of the orbiting scroll lap 66E in contact with the fixed scroll lap 26E, the secondary refrigerant pathway 96 is closed. As the orbiting scroll 66 orbits about the center axis 90C, the tail end of the orbiting scroll lap 66E moves away from the fixed scroll lap 26E towards the fixed scroll outer wall 26F.

Once the fixed scroll lap 26E overlaps or extends over the slot 98 in the fixed scroll 26, this opens and allows refrigerant to enter the compression chamber 80 via both the primary and secondary pathways 94, 96. In one aspect of the present invention, the secondary refrigerant pathway 96 is fully open at a predetermined point within the compression cycle. In the illustrated embodiment, the predetermined point is approximately halfway within the compression cycle. Further, as shown, the slot may be adjacent to the fixed scroll wall 26F.

In another aspect of the present invention, the compression chamber 80 expands during the compression cycle and may be at a minimum volume, including, but not limited to 0 $cm^3$, at the initiation of the compression cycle. Further, the compression chamber 80 may be at a maximum volume at approximately one half of the displacement of the compressor, for example, at 18 cm3 of a compressor with a 36 cm3 displacement.

As shown in FIGS. 4A, 4B, and 5D-5F, the fixed scroll has an inner diameter, $d_{inner}$, defined by the outer wall 26F of the fixed scroll 26. In another aspect of the present invention, the slot 98 is within the inner diameter $d_{inner}$. This ensures that the provision of the secondary refrigerant pathway 96 and the slot 98 in the fixed scroll 26 does not result in an increase in size of the compressor 10.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed:

1. A scroll-type electric compressor configured to compress a refrigerant, comprising:

a housing defining an intake volume and a discharge volume;

a refrigerant inlet port coupled to the housing and configured to introduce the refrigerant to the intake volume;

a refrigerant outlet port coupled to the housing and configured to allow compressed refrigerant to exit the scroll-type electric compressor from the discharge volume;

an inverter module mounted inside the housing and adapted to convert direct current electrical power to alternating current electrical power;

a motor mounted inside the housing;

a drive shaft coupled to the motor; and, a compression device coupled to the drive shaft and being configured to receive the refrigerant from the intake volume, the compression device including a fixed scroll and an orbiting scroll, the fixed scroll having first and second sides of the fixed scroll and being located within, and fixed relative to, the housing, the orbiting scroll having first and second sides of the orbiting scroll, the fixed scroll including:

a fixed scroll base defining a fixed scroll base floor and being located at the first side of the fixed scroll;

a fixed scroll lap extending from the fixed scroll base floor towards the second side of the fixed scroll, the orbiting scroll including:

an orbiting scroll base located at the first side of the orbiting scroll, and an orbiting scroll lap extending from the orbiting scroll base towards the second side of the orbiting scroll, the orbiting scroll coupled to the drive shaft, the orbiting scroll and the fixed scroll forming a compression chamber for receiving the refrigerant from the intake volume and compressing the refrigerant during a compression cycle as the drive shaft is rotated, the fixed scroll having a slot within the first side of the fixed scroll, the slot defining a secondary refrigerant pathway configured to allow refrigerant to enter the compression chamber during a compression cycle, wherein the secondary refrigerant pathway is closed at initiation of the compression cycle, wherein the secondary refrigerant pathway is fully open at a predetermined point within the compression cycle.

2. The scroll-type electric compressor, as set forth in claim 1, wherein the predetermined point is approximately halfway within the compression cycle.

3. The scroll-type electric compressor, as set forth in claim 1, the fixed scroll includes a fixed scroll wall, the slot being adjacent the fixed scroll wall.

4. The scroll-type electric compressor, as set forth in claim 1, wherein the compression chamber expands during the compression cycle, wherein the compression chamber is at a minimum volume at the initiation of the compression cycle.

5. The scroll-type electric compressor, as set forth in claim 4, wherein the compression chamber is at a maximum volume at the predetermined point within the compression cycle.

6. The scroll-type electric compressor, as set forth in claim 1, wherein the fixed scroll has an inner diameter defined by the outer wall of the fixed scroll and the slot is within the inner diameter.

7. A compression device for use in a scroll-type electric compressor, comprising:

a fixed scroll including a fixed scroll base defining a fixed scroll base floor and being located at a first side of the fixed scroll and a fixed scroll lap extending from the fixed scroll base floor towards a second side of the fixed scroll, an orbiting scroll including an orbiting scroll base located at a first side of the orbiting scroll, and an orbiting scroll lap extending from the orbiting scroll base towards a second side of the orbiting scroll, the orbiting scroll and the fixed scroll forming a compression chamber for receiving the refrigerant from an intake volume and compressing the refrigerant as the orbiting scroll is rotated about the fixed scroll, the fixed scroll having a slot within a first side of the fixed scroll, the slot defining a secondary refrigerant pathway configured to allow refrigerant to enter the compression chamber during a compression cycle, wherein the secondary refrigerant pathway is closed at initiation of the compression cycle, wherein the secondary refrigerant pathway is fully open at a predetermined point within the compression cycle.

8. The compression device, as set forth in claim 7, wherein the predetermined point is approximately halfway within the compression cycle.

9. The compression device, as set forth in claim 7, wherein the fixed scroll includes a fixed scroll wall, the slot being adjacent the fixed scroll wall.

10. The compression device, as set forth in claim 7, wherein the compression chamber expands during the compression cycle, wherein the compression chamber is at a minimum volume at the initiation of the compression cycle.

11. The compression device, as set forth in claim 10, wherein the compression chamber is at a maximum volume at the predetermined point within the compression cycle.

12. The compression device, as set forth in claim 7, wherein the fixed scroll has an inner diameter defined by the outer wall of the fixed scroll and the slot is within the inner diameter.

13. A scroll-type electric compressor configured to compress a refrigerant, comprising:

a housing defining an intake volume and a discharge volume;

a refrigerant inlet port coupled to the housing and configured to introduce the refrigerant to the intake volume;

a refrigerant outlet port coupled to the housing and configured to allow compressed refrigerant to exit the scroll-type electric compressor from the discharge volume;

an inverter module mounted inside the housing and adapted to convert direct current electrical power to alternating current electrical power;

a motor mounted inside the housing;

a drive shaft coupled to the motor; and, a compression device coupled to the drive shaft and being configured to receive the refrigerant from the intake volume, the compression device including a fixed scroll and an orbiting scroll, the fixed scroll having first and second sides of the fixed scroll and being located within, and fixed relative to, the housing, the orbiting scroll having first and second sides of the orbiting scroll, the fixed scroll including:

a fixed scroll base defining a fixed scroll base floor and being located at the first side of the fixed scroll;

a fixed scroll lap extending from the fixed scroll base floor towards the second side of the fixed scroll, the orbiting scroll including:

an orbiting scroll base located at the first side of the orbiting scroll, and an orbiting scroll lap extending from the orbiting scroll base towards the second side of the orbiting scroll, the orbiting scroll coupled to the drive shaft, the orbiting scroll and the fixed scroll forming a compression chamber for receiving the refrigerant from the intake volume and compressing the refrigerant during a compression cycle as the drive shaft is rotated, the fixed scroll having a slot within the first side of the fixed scroll, the slot defining a secondary refrigerant pathway configured to allow refrigerant to enter the compression chamber during the compression cycle, wherein the secondary refrigerant pathway is closed at initiation of the compression cycle and the secondary refrigerant pathway is fully open at a predetermined point within the compression cycle, the predetermined point is approximately halfway within the compression cycle, the fixed scroll including a fixed scroll wall, the slot being adjacent the fixed scroll wall.

14. The scroll-type electric compressor, as set forth in claim 13, wherein the compression chamber expands during the compression cycle, wherein the compression chamber is at a minimum volume at the initiation of the compression cycle.

15. The scroll-type electric compressor, as set forth in claim 14, wherein the compression chamber is at a maximum volume at the predetermined point within the compression cycle.

16. The scroll-type electric compressor, as set forth in claim 13, wherein the fixed scroll has an inner diameter defined by the outer wall of the fixed scroll and the slot is within the inner diameter.

* * * * *